US008435102B2

(12) United States Patent
Calleja LaFuente et al.

(10) Patent No.: US 8,435,102 B2
(45) Date of Patent: May 7, 2013

(54) COIN DISPENSER

(75) Inventors: Miguel A. Calleja LaFuente, Peralta (ES); Oscar Lacarra Fernandez, Peralta (ES); Alvaro Martinez Chavoy, Peralta (ES); Bernardo Sola Sanchez, Peralta (ES); Silvia Jimenez Zozaya, Peralta (ES); Juan Miguel Irurita Loyarte, Peralta (ES)

(73) Assignee: Azkoyen, S.A., Peralta, Navarra (ES)

( * ) Notice: Subject to any disclaimer, the term of this patent is extended or adjusted under 35 U.S.C. 154(b) by 0 days.

(21) Appl. No.: 13/457,266

(22) Filed: Apr. 26, 2012

(65) Prior Publication Data

US 2012/0276829 A1 Nov. 1, 2012

(30) Foreign Application Priority Data

Apr. 28, 2011 (ES) ..... 201130673
Mar. 13, 2012 (ES) ..... 201230370

(51) Int. Cl.
*G07D 3/00* (2006.01)

(52) U.S. Cl.
USPC ..... 453/13; 453/12; 453/33; 453/49; 453/57

(58) Field of Classification Search ..... 453/6, 10, 453/12, 13, 33–35, 49, 57
See application file for complete search history.

(56) References Cited

U.S. PATENT DOCUMENTS 5,074,824 A 12/1991 Suris

FOREIGN PATENT DOCUMENTS

| | | |
|---|---|---|
| EP | 0 959 437 | 11/1999 |
| EP | 1 717 762 | 11/2006 |
| EP | 1 968 018 | 9/2008 |
| WO | WO 2004/114228 | 12/2004 |
| WO | WO 2006/079803 | 8/2006 |

*Primary Examiner* — Jeffrey Shapiro
(74) *Attorney, Agent, or Firm* — Merchant & Gould P.C.

(57) ABSTRACT

A coin dispenser including a coin storing unit (1) and a coin extractor (3), the casing of which (4) demarcates a cylindrical chamber (5) with side outlet (6) for the exit of coins, in which there is housed a rotary driving disc (7) which has a series of cavities (8) closed, on the side opposite to that occupied by the coin storing unit, by a base disc (9) forming stops (14) opposite the rotation direction of the driving disc (7). The disc has retractable parts (13) which, together with the stops (23), control the exit of coins driven in the cavities (8).

11 Claims, 14 Drawing Sheets

FIG. 6
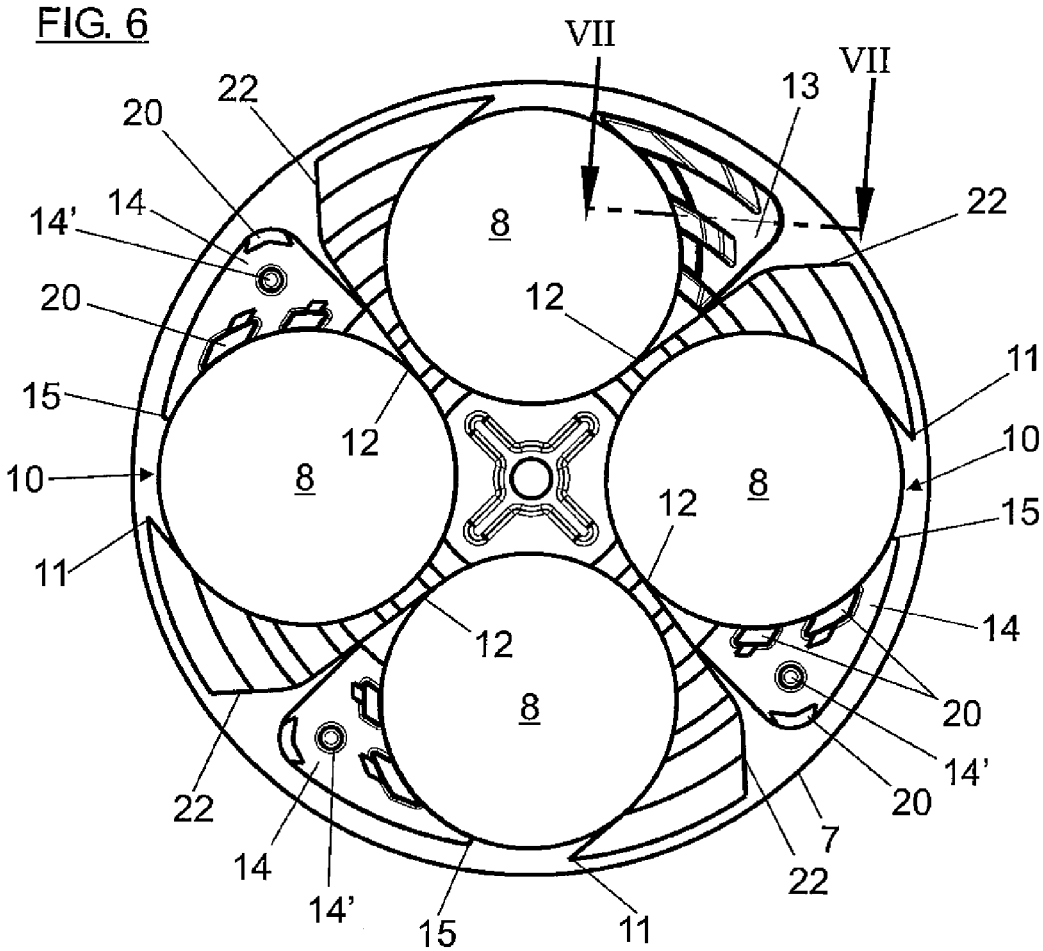
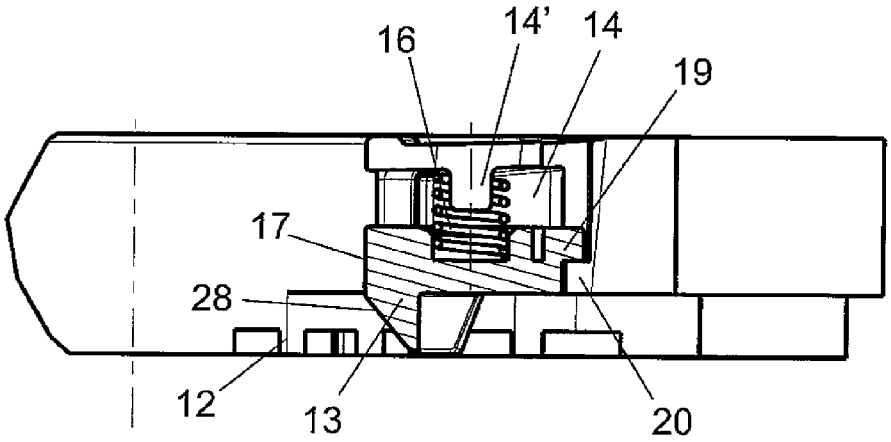
FIG. 7

COIN DISPENSER

This application claims benefit of Serial No. 201130673, filed 28 Apr. 2011 and Serial No. 201230370 filed 13 Mar. 2012 in Spain and which applications are incorporated herein by reference. To the extent appropriate, a claim of priority is made to each of the above disclosed applications.

FIELD OF THE INVENTION

The present invention relates to a coin dispenser intended to be used as a unit for issuing coins in applications such as automatic vending machines, gaming machines, parking meters, etc.

The dispenser of the invention is of the type comprising a coin storing unit and a coin extracting unit.

More specifically the dispenser of the invention is of the type the extractor of which is made up of a casing defining a cylindrical chamber with a side outlet in which there is housed a rotary driving disc limiting the coin storing unit on one side and having a series of cavities which are closed on the side opposite to that occupied by the coin storing unit by a supporting base. The cavities house and drive the coins and have in the wall, from the edge facing the supporting base, a notch, demarcating, with said base a path facing the side outlet of the cylindrical chamber for the exit of the coins.

BACKGROUND OF THE INVENTION

Coin dispensers used for returning coins in change machines, gaming machines, vending machines, etc are already known.

Documents EP 1717762 B1, EP 1968018 A2, WO2004/114228 A1 and U.S. Pat. No. 5,074,824 describe coin returning mechanisms based on a rotary disc in which the coins are transported to the exit as a result of the action of the rotary disc with a special geometry and a stop or trigger. Devices of this type are suitable for extracting different coins but with the limitation that the cavities must have a suitable geometry to extract the coin with larger diameter and/or thickness and that at the same time two thin coins and/or coins with small diameter cannot be extracted. This limitation means that this coin dispenser must be modified depending of the range of coins with larger and smaller desired diameter and/or thickness, in some cases the compatibility of coins with different diameters and/or thicknesses with the same extraction disc being impossible.

Document EP 1717762 B1 describes a system for extracting coins using a fixed and a movable stop or trigger. This system has the particularity that the distance between the fixed stop and movable trigger must be adjusted for each range of coins, different systems being necessary for each range of coins.

In the mechanism described in documents EP 1968018 A2 and WO 2004/114228 A1, the system for extracting coins uses a movable trigger formed by one or two parts and a fixed adjustable plate responsible for ejecting the coins. This system is less complex than other trigger systems but it still has ranges of coins limitations, defining a system having a movable trigger and an adjustment plate for different ranges of coins being necessary.

Document EP 0959437 B1 describes a coin dispenser based on a rotary disc as those described above in which two rotary discs overlap, the diameter of the accepted coins being able to be adjusted by means of mismatching one disc with respect to the other. This device behaves better with respect to the amount of discs used for extracting coins but it continues to have range limitations.

WO 2006/079803A describes a coin dispenser which has an outlet opening for the exit of coins and a coin dispensing mechanism comprising a rotary disc provided with cylindrical cavities for the coins, means for pushing the coin towards the outlet opening which means occupy the lower position in the cylindrical cavities and means for controlling the exit of the coins, one by one, through the outlet opening.

The means for pushing the coins towards the outlet opening consist of retractable stops which protrude from the bottom of the deposit in a fixed radial position, coinciding with the outlet opening, and block the circumferential trajectory of the cavities, pushing the coin occupying the lower position in the cavity facing the outlet opening towards said opening. The means for controlling the exit of the coins in turn consist of two retractable arched gates which are assembled in a position concentric with the rotary disc, in an inverted channel surrounding said disc coinciding with the outlet opening, said gates having an inclined lower profile. With the described constitution, the two retractable arched gates make up the means for controlling the exit of the coins from all the cavities, such that the operation problems of any of the gates could alter the operation of the entire dispenser.

On the other hand, the exit of the coins occurs only due to the push received by said coins from the retractable stop, where the coin may not reach the end of the outlet due to the friction of the coin along the exiting path, for example if the stop is retracted, or at least doing so at a minimum speed.

On the other hand, the limitation of coins with the smallest diameter allowed is established by the shape demarcated by the ribs of the lower face of the disc in each of the cavities, which may allow housing two coins the sum of the diameters of which slightly exceeds that of the cavities, causing the simultaneous exit of the two coins or a jam. This feature limits the range of allowed coin diameters.

SUMMARY OF THE INVENTION

The object of the present invention is a coin dispenser issuing coins efficiently as a unit and preventing the drawbacks of the systems known in the state of the art.

One object of the invention is to solve the mentioned problems by means of a coin dispenser of the type initially indicated which is able to reliably work with a wide range of coins, both in diameter and in thickness.

Another object of the invention is to develop a coin dispenser which is of simple construction and robust which also facilitates its use in applications requiring low cost and high reliability such as, for example, the case of vending machines, gaming machines or gambling machines, etc.

Based on the mentioned general construction the dispenser of the invention is characterised in that a stop opposite to the rotation direction of the disc protrudes from the surface of the supporting base facing the driving disc. This stop radially crosses the circular trajectory of the cavities of the driving disc and its height is equal to or less than the thickness of the coin with the least thickness allowed. The mentioned stop is movable according to a circular trajectory concentric with the driving disc between an advanced position in which it faces the side outlet of the cylindrical chamber, limiting the length of said outlet to a dimension less than the diameter of the coin with the smallest size allowed, and a retracted position in which it is located directly behind the side outlet, according to the rotation direction of the driving disc. The mentioned stop is consistently driven towards the advanced position by means of a spring.

According to another feature of the invention, the rotary disc has a retractable part for each cavity partially protruding through the rear surface of the disc blocking the notch which limits, with the base, the path for the coins to exit the cavity. Furthermore, the disc subsequently comprises an arched coin guiding wall located after the retractable part and starts in a position tangent to said cavity, running towards the periphery of the disc with the convexity directed towards the cavity. This wall will have a height at least equal to that of the coin with the greatest thickness allowed.

With the described constitution, each of the cavities for housing the coins is defined by the corresponding hole or empty space of the driving disc and by the retractable part which, together with the geometry of the driving disc, form the cavities for housing the coins. These cavities will have a cylindrical configuration with a diameter equal to that of the coin with the largest diameter allowed, but less than the sum of the diameters of two coins with the smallest diameter allowed, such that two coins with the smallest diameter allowed cannot be housed on the base of each cavity. The retractable parts further have a path, perpendicular to the driving disc, slightly greater than the thickness of the coin with the greatest thickness allowed. The range of coins which can be dispensed one by one with the same dispenser device is thus increased, both in diameter and in thickness.

According to a preferred embodiment the cavities of the driving disc have an oblique cylindrical configuration with the shaft inclined in circumferential direction, opposite to the rotation direction of said driving disc, whereby the coins inside each cavity will be stacked following the inclination of said cavity, the edges of the coins being offset or staggered.

With the described constitution actuating the coin occupying the innermost position on the retractable part will be facilitated in each cavity when said coin reaches the stops of the supporting base thereby reducing the risk of jams.

On the other hand the oblique cylindrical configuration of the cavities prevents or at least hinders the coins penetrating said cavities from being able to be located inside same in a position perpendicular to the bottom of said cavities. In contrast, it is assured that the coins are located in the cavities as they penetrate same, in overlapping positions, parallel to the bottom of the cavities.

The oblique cylindrical shaped cavities will preferably end in oblique cylindrical end sections with parallel axes and offset with respect to one another in circumferential position to facilitate both the entry of the coins into the cavities and the positioning and exit of the coin located at all times in the innermost position of the cavity, to assure a correct operation on the retractable part.

The supporting base from which the aforementioned stop protrudes can be made up of a base disc arranged between the bottom of the cylindrical chamber and the driving disc concentric with said disc. The mentioned base disc can rotate together with the driving disc between the aforementioned advanced and retracted positions of the stop. The stop can consist of one or more flanges protruding from the base disc radially aligned thereon.

According to an embodiment variant the base disc can be fixed and be provided with concentric arched grooves and have an angular width at least equal to the movement which the stop can experience between its advanced and retracted positions. The stops will be made up of teeth located below the base disc, radially aligned with respect to said disc coinciding in number and position with the arched grooves of the base disc. These teeth protrude through the grooves at a height equal to or less than the thickness of the coins with the least thickness allowed. Furthermore, the teeth will be movable along the grooves between the advanced and retracted positions of the stop.

In the aforementioned embodiments in the resting position of the flanges or teeth, these are located such that they will partially block the side outlet of the cylindrical chamber in which the driving disc is housed, leaving a passage section which is smaller than the diameter of the smallest coin allowed.

All the features set forth and other typical features of the invention, as well as the way of operating the dispenser of the invention will be set forth in greater detail in the embodiment shown in the attached drawings.

BRIEF DESCRIPTION OF THE DRAWINGS

The attached drawings correspond to a dispenser formed according to the invention and given by way of non-limiting example.

In the drawings:

FIG. 6 is a plan view of the driving disc of FIG. 4.

FIG. 7 is a partial cross-section view of the driving disc taken according to section line VII-VII of FIG. 6.

DETAILED DESCRIPTION OF AN EMBODIMENT

Figure 1:
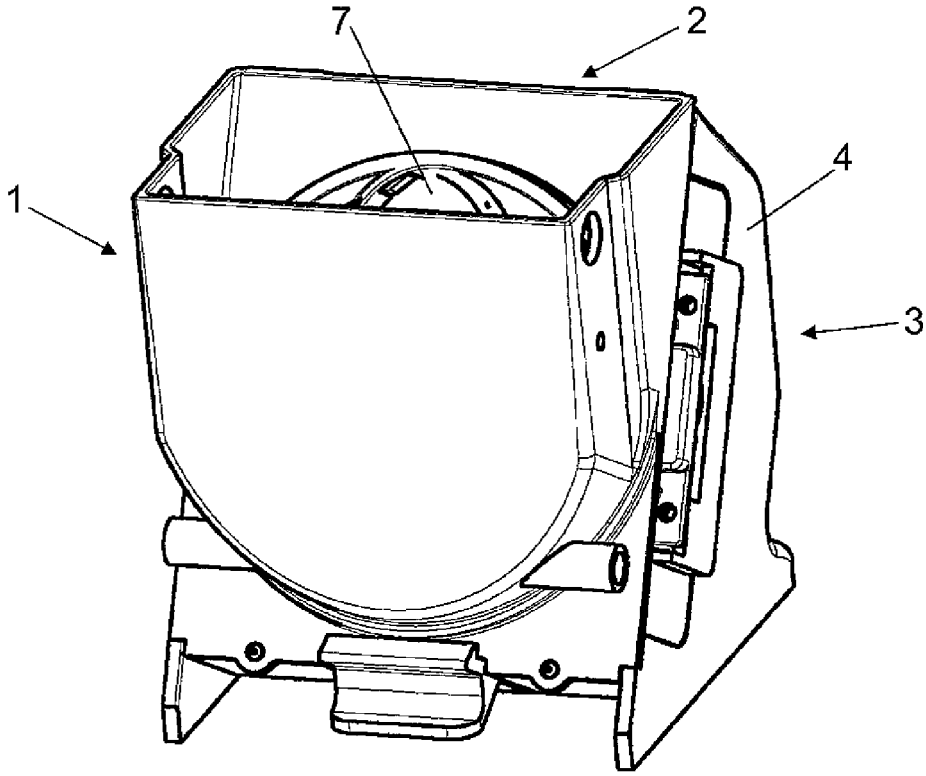
FIG. 1 is a perspective view of a dispenser formed according to the invention.
Figure 2:
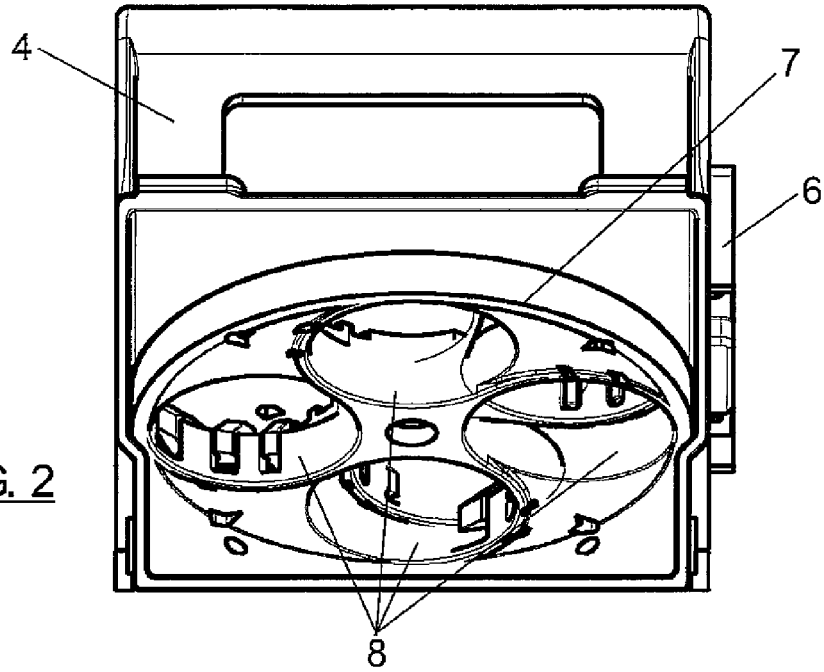
FIG. 2 is a plan view of the extractor of FIG. 1.

FIG. 1 shows a coin dispenser formed according to the invention, which is made up of a coin storing unit 1, with loading mouth 2, and a coin extractor 3 comprising a casing 4 to which the storing unit 1 is fixed.

Figure 3:
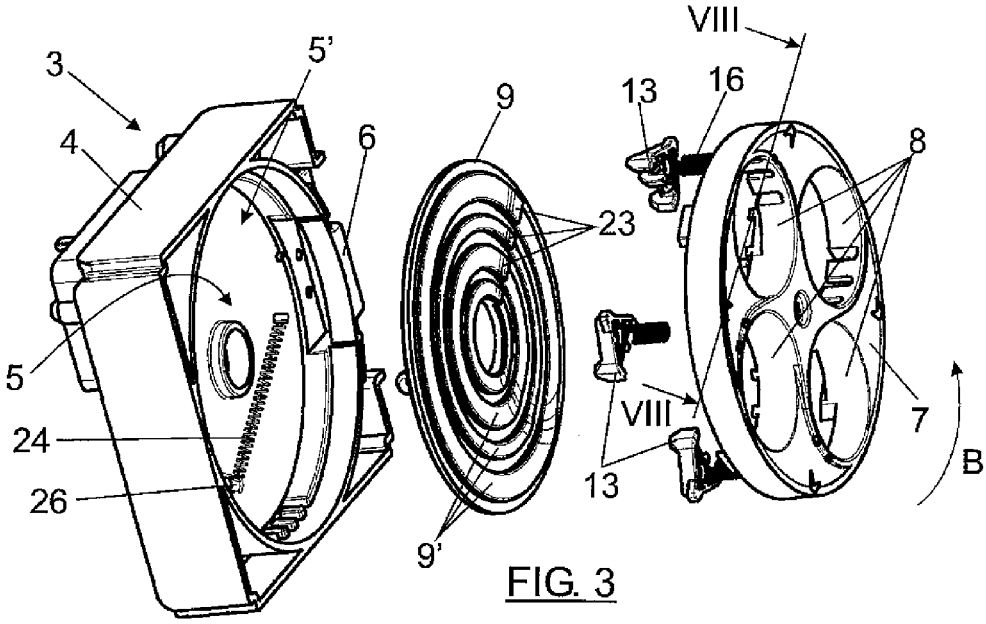
FIG. 3 is a perspective exploded view of the coin extractor forming part of the dispenser of FIG. 1.

As can be seen in FIG. 3, the casing 4 defines a cylindrical chamber 5 having a side outlet 6 for the exit of coins, as will be discussed below. A driving disc 7 limiting and closing the storing unit 1 on one side, FIG. 1, is housed in the chamber 5.

Other components not depicted, such as a geared motor for operating the driving disc 7, coin level and exit sensors, electronic control, etc., not depicted and all those having known arrangement, are additionally assembled on the casing 4.

The driving disc 7 has circumferentially distributed cylindrical cavities 8, which are closed, on the side opposite to that occupied by the coin storing unit 1, by a supporting base which in the depicted example is configured in the form of a base disc 9, arranged between the bottom 5' of the cylindrical chamber 5 and the driving disc 7. The cavities 8 will be deep enough to enable housing two or more overlapping coins of diameter at least equal to that of the coin with the largest dimension allowed, but less than twice the diameter of the coin with the smallest diameter allowed.

Figure 4:
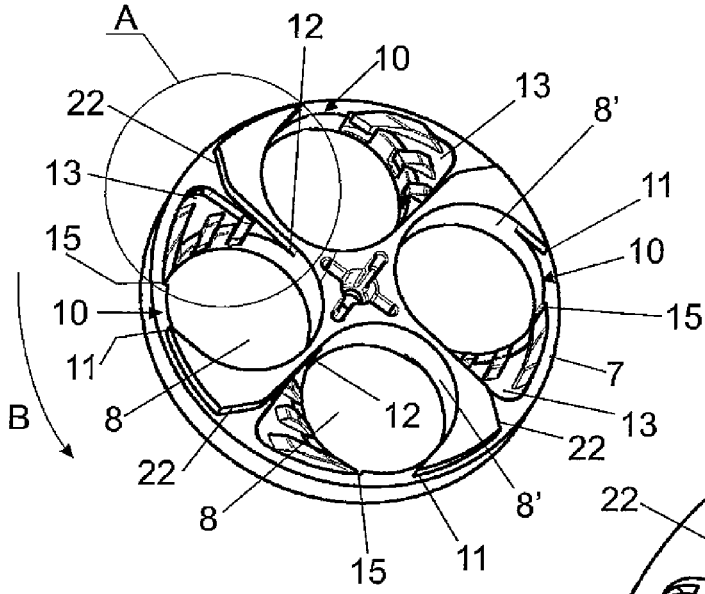
FIG. 4 is a rear perspective view of the driving disc of the extractor of FIG. 3.
Figure 5:
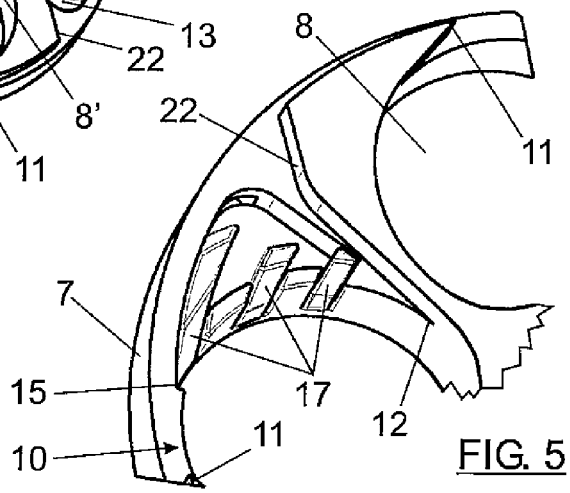
FIG. 5 corresponds to detail A of FIG. 4 on a larger scale.

As can be seen in FIGS. 4 and 5, the wall limiting the cavities 8 has, from the edge facing the base disc 9, a notch 10 running between points 11 and 12, along an arch wide enough to allow the passage of the coin with the largest diameter allowed. This arch will have an angular width equal to or greater than 180°. Coinciding with the notch 10 of each cavity 8 the driving disc 7 has, from the surface facing the base disc 9, a housing 14 in which there is assembled a retractable part 13 which faces the base disc 9, as can be seen in FIGS. 6 to 9, and it can be moved in a direction perpendicular to said base disc 9 between an extracted position, FIG. 8, and a retracted position, FIG. 9. In the extracted position the retractable part partially blocks the notch 10, leaving a section thereof free, between the points 11 and 15, FIG. 4, the cord of which is shorter than the diameter of the coin with the smallest diameter allowed. This retractable part is driven towards the extracted position by means of a spring 16, FIGS. 7 and 8, assembled around the pivot 14'.

Figure 8:
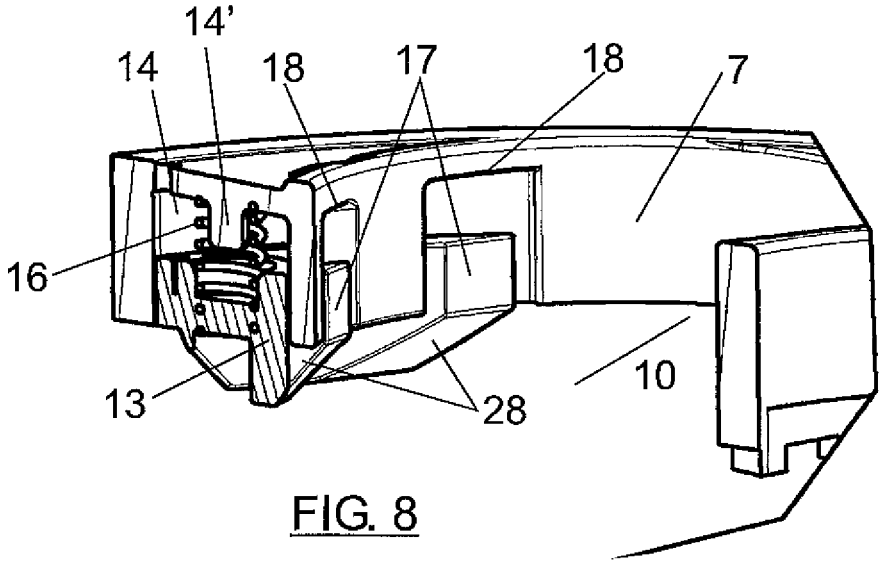
FIGS. 8 and 9 are perspective partial cross-section views of the driving disc with the retractable part in the extracted and retracted positions, respectively, taken according to section lines VIII-VIII of FIG. 3.
Figure 9:
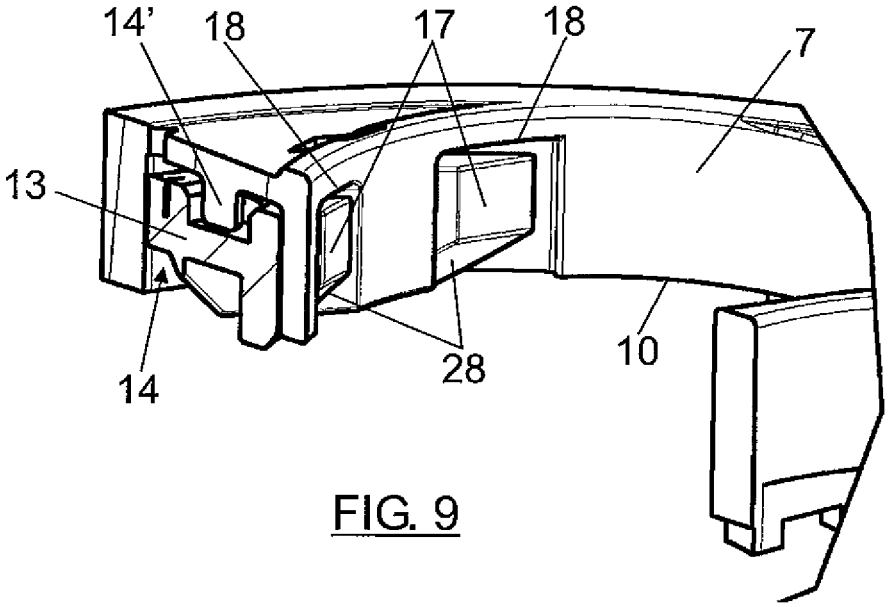
Figure 10:
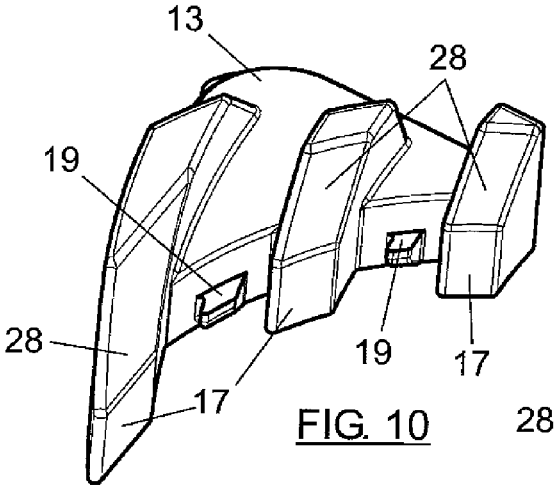
FIG. 10 is a perspective view of the retractable part.
Figure 11:
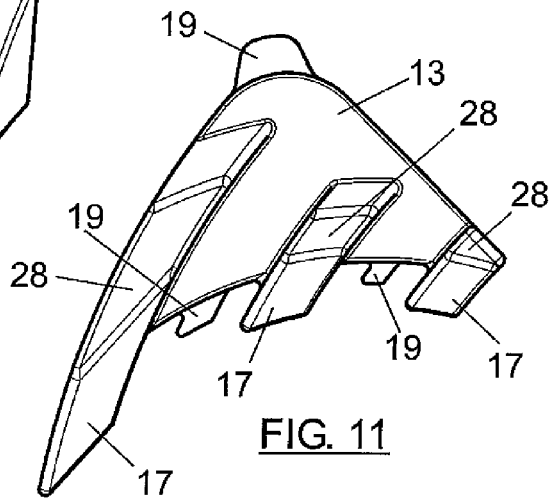
FIG. 11 is an upper plan view of the same retractable part.

FIGS. 10 and 11 depict the retractable part 13, which has flanges 17 protruding through notches 18 of the housing 14, FIGS. 8 and 9. Furthermore these retractable parts 13 also have protrusions 19 resting on stops 20, FIG. 7, formed in the housings 14 to limit the position of maximum extraction of the retractable part 13.

FIG. 6 shows the driving disc on the surface facing the base disc 9 with the housings 14, in one of which the retractable part 13 is assembled, the extracted position of which, FIG. 7, is limited by the stops 20. The pivot 14' on which the spring 16 is mounted protrudes from the bottom of the housings 14.

From the driving disc 7 there protrudes, FIGS. 4 to 6, from the surface facing the base disc 9 and through each cavity 8, a coin guiding wall 22 located after each retractable part 13, which starts in a position tangent to said cavity, and to the corresponding housing 14, from point 12, and runs with an arched route towards the periphery of the driving disc, with the convexity directed towards the retractable part 13. This wall will have a height at least equal to the thickness of the coins with the greatest thickness allowed.

Figure 13:
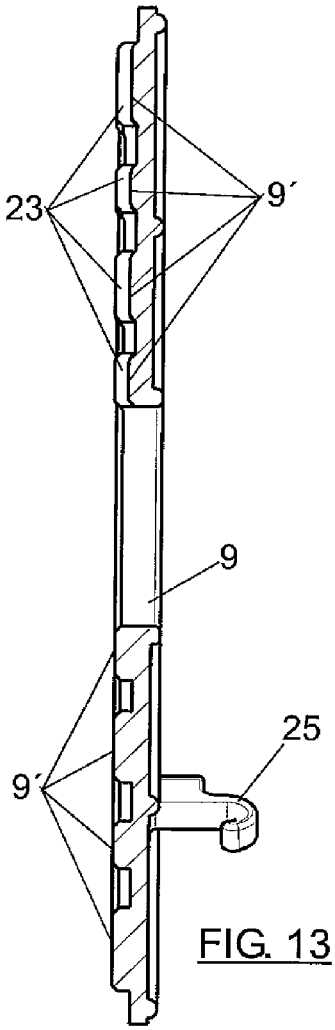
FIG. 13 is a diametric cross-section view of the base disc taken according to section line XIII-XIII of FIG. 12.
Figure 12:
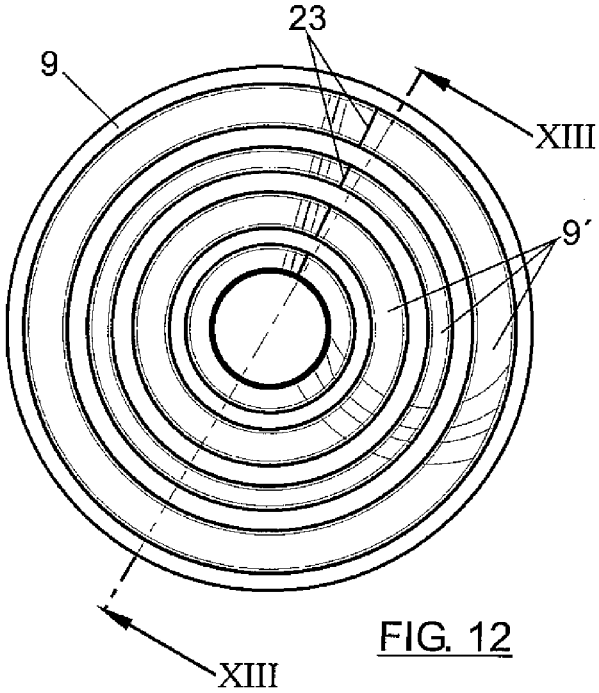
FIG. 12 is a plan view of the base disc included in the extractor of FIG. 3.

In the depicted example the base disc 9 making up the supporting base for the driving disc 7 has concentric ribs 9', FIGS. 3, 12 and 13, the height of which varies between coinciding points of minimum and maximum height, where a flange is formed in each rib defining a stop 23, in all the ribs the stops 23 being radially aligned and oriented in the direction opposite the rotation direction of said driving disc, such that these stops will radially cross the circular trajectory of the cavities 8. The stops 23 will have a height equal to or less than the thickness of the coin with the least thickness allowed.

Figure 24:
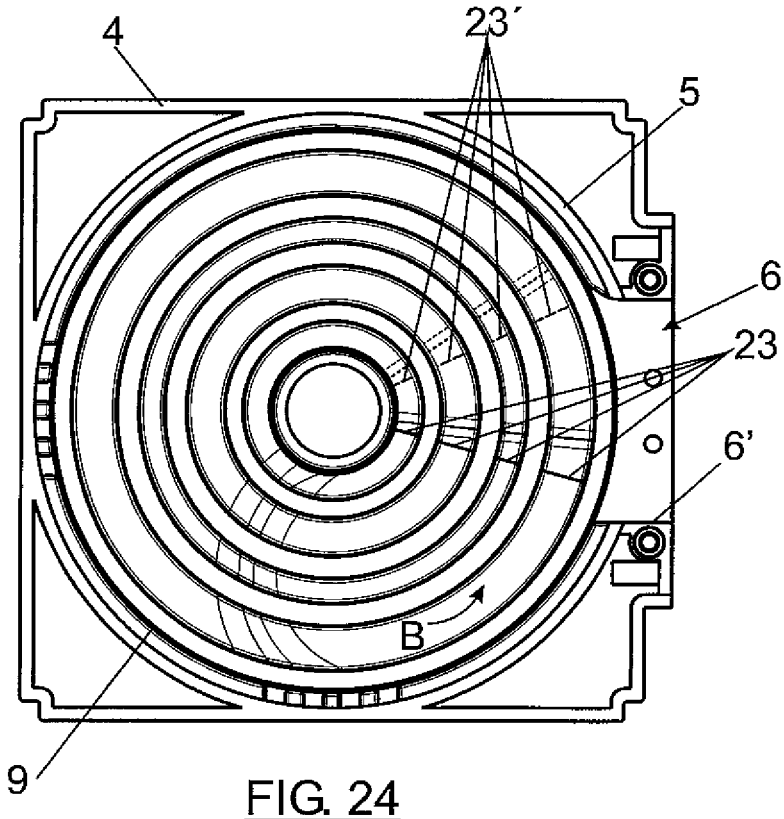
FIG. 24 is an elevational view of the casing with the base disc included.
Figure 25:
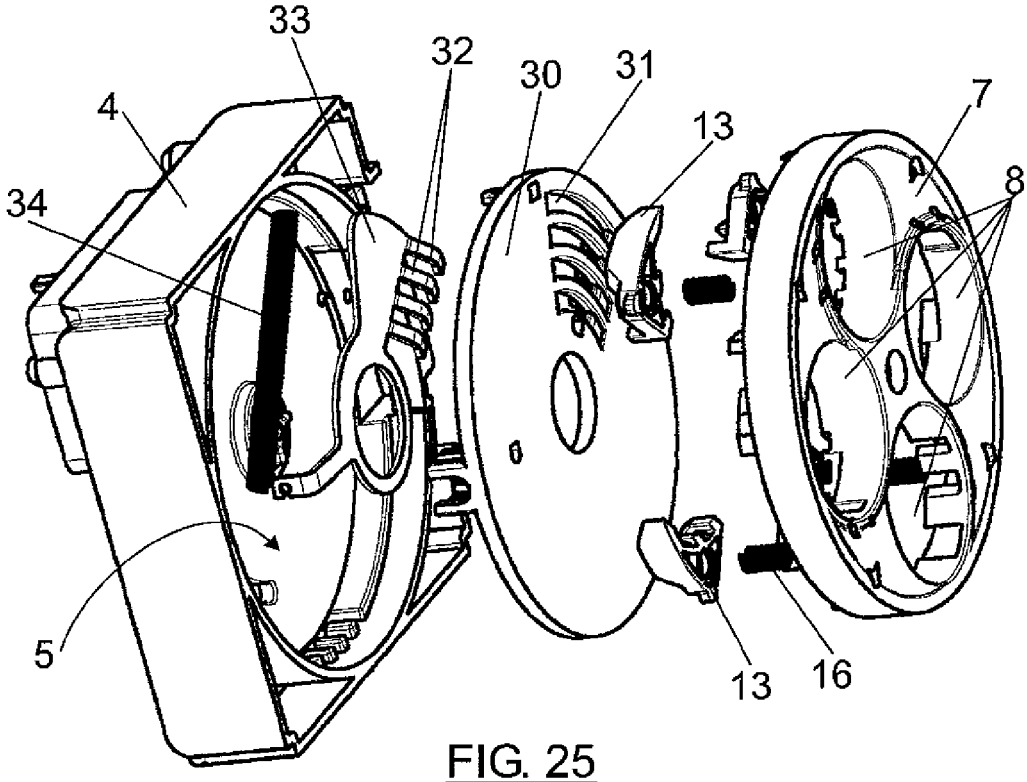
FIG. 25 is a view similar to FIG. 3 showing an embodiment variant.
Figure 26:
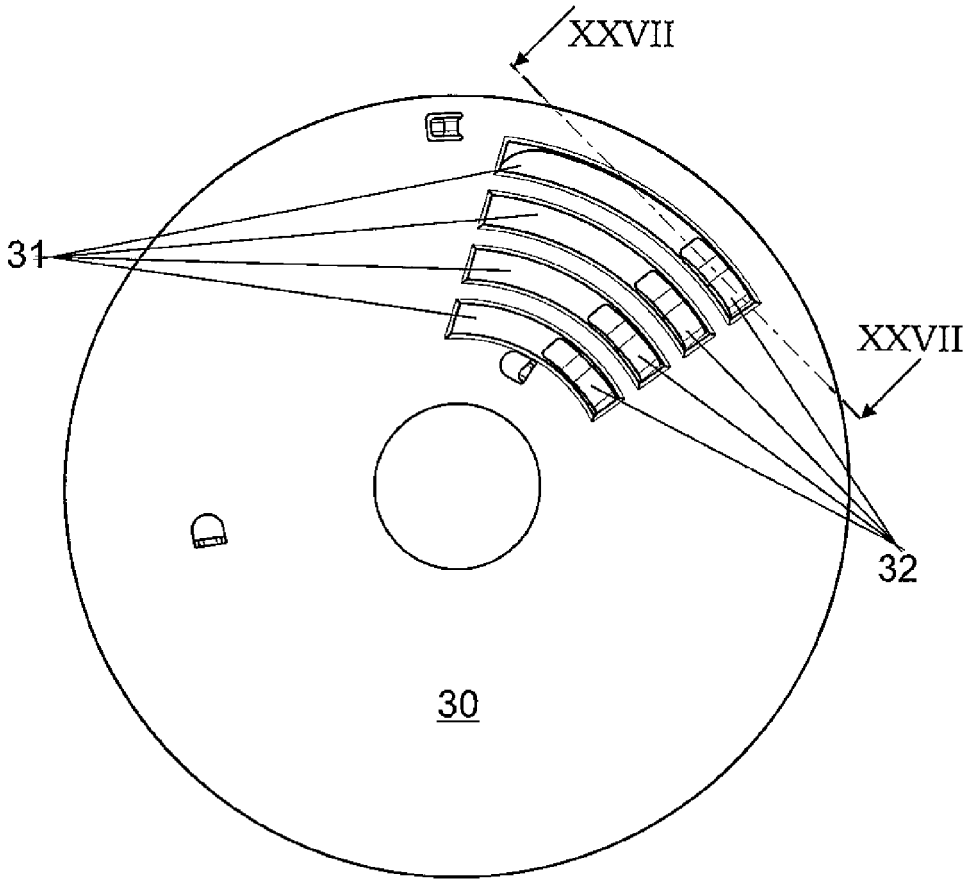
FIG. 26 is a plan view of the base disc included in the casing of the extractor.

As shown in FIG. 24, the base disc 9 is a rotary disc inside the chamber 5, rotating between an advanced position, in which the stops 23 face the side outlet 6 of the cylindrical chamber 5, blocking said outlet and limiting the free length thereof to a dimension less than the diameter of the coin with the smallest size allowed, and a retreated position in which the stops 23' are located directly behind the side outlet 6. The base disc 9 and therewith the stops 23, are driven towards the advanced position 23 of FIG. 24 by means of a spring 24, FIG. 3, for example a tension spring, assembled between a catch 25 of the base disc 9, FIG. 13, and a catch 26 of the cylindrical chamber 5, FIG. 3. The rotation of the base disc 9 from the advanced position, with the stops 23 blocking the outlet 6, to the retreated position, where the stops 23' are located after the outlet 6, is achieved by rotating the driving disc 7, through the coins housed in the cavities 8, which are driven by the retractable parts 13 when the driving disc rotates in the direction of arrow B of FIGS. 3, 4 and 24. When a cavity 8 with coins reaches the position of the stops 23, the coin occupying the lower position will rest on said stops and drive the base disc 9 until locating the stops in position 23'. The spring 24 will have greater tension than the spring 16 responsible for driving the retractable part towards its extracted position.

In the extracted position of the retractable part, FIG. 8, the flanges 17 thereof are separated from the supporting base defined by the base disc 9 by a distance less than the thickness of the coin with the least thickness allowed, preventing the exit of coins. In the retracted position, FIG. 9, the flanges 16 are separated from the supporting base by a distance greater than the coin with the greatest thickness allowed but less than twice the thickness of the coin with the least thickness allowed, allowing the exit of a coin since the cavity faces the outlet 6 of the chamber 5, as will be set forth below.

As can be seen in FIGS. 8 and 9, the front of the flanges 17 of the retractable part 13 are limited on the lower part at the side directed towards the corresponding cavity 8, by an inclined surface 28, progressively retracted towards the free edge.

Figure 14:
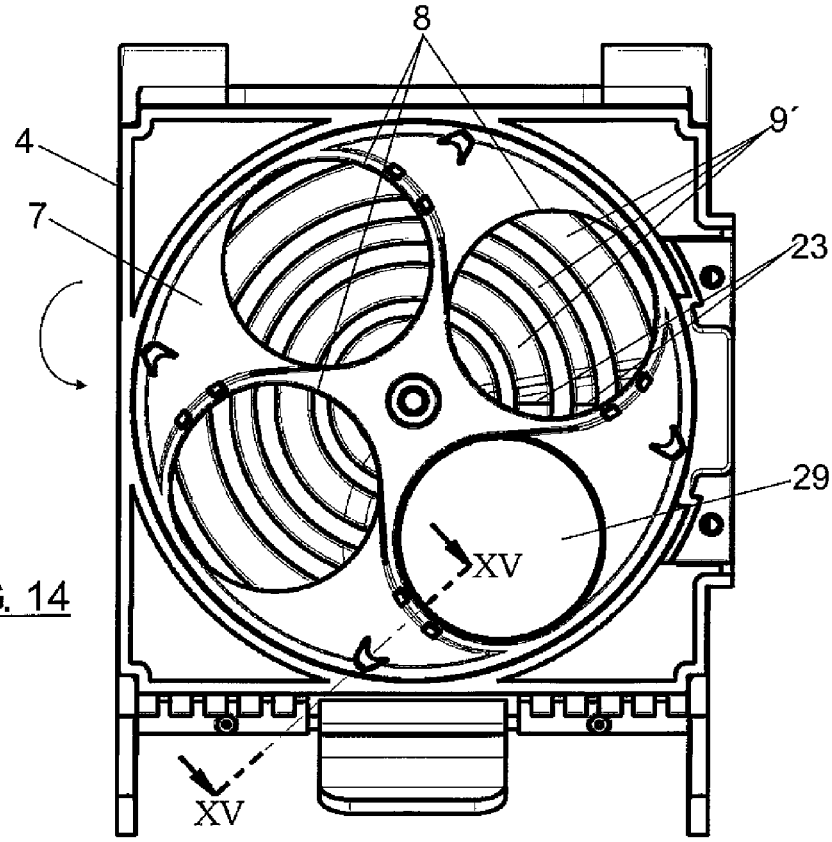
FIG. 14 is an elevational view of the extractor with a coin close to the extraction point.
Figure 15:
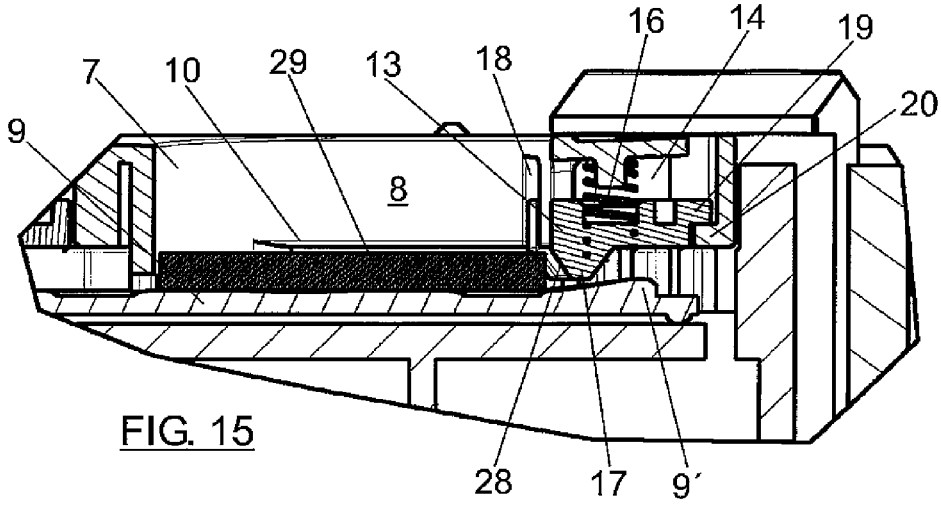
FIG. 15 is a partial cross-section view of the extractor taken according to section line XV-XV of FIG. 14.
Figure 17:
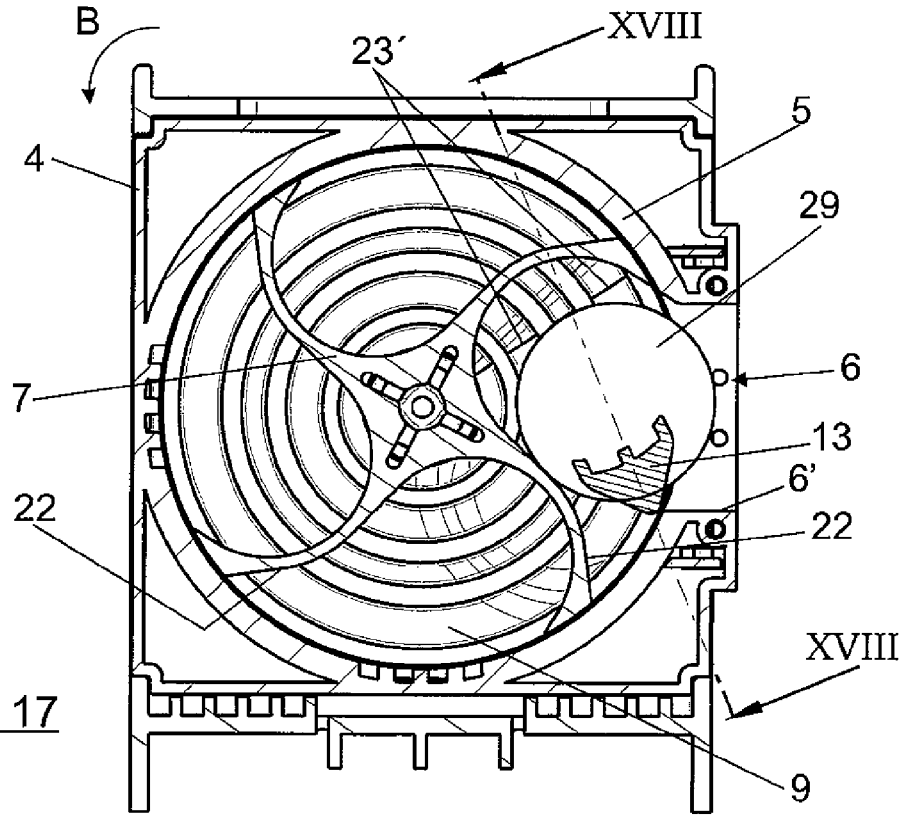
FIG. 17 is an elevational view similar to FIG. 16 with the coin located facing the outlet of the extractor.

With the described constitution the retractable parts 13 in their extracted position partially close the notch 10 of the cavities 8 limited between points 11 and 12 and with it the path 21, limited between the bottom of said notches 10 and base disc 9, FIGS. 18, 21, 22 and 23, leaving a restricted path 10 between points 11 and 15, FIG. 4, which does not allow the passage of the coins with the smallest diameter allowed, the cavities 8 thus being able to drive one or more coins 29 from the coin storing unit 1, as depicted in FIGS. 14 and 15, until the driving disc reaches a position more advanced than that depicted in FIG. 14, in which the coin 29 rests on the stops 23 of the base disc 9, like that depicted in FIG. 17. From this position, as the driving disc 7 keeps rotating in the direction of arrow B, the coin 29 will push against the stops 23, causing the base disc 9 to rotate together with the driving disc.

Figure 27:
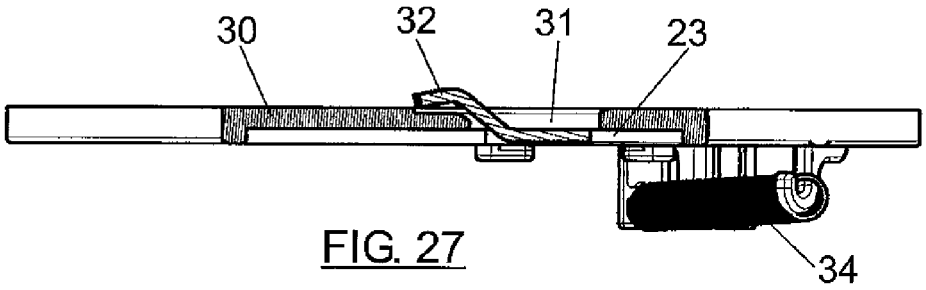
FIG. 27 is a partial cross-section view of the same base disc taken according to section line XXVII-XXVII of FIG. 26.

The process for extracting the coins 29 is performed in four phases. In a first phase, the driving disc 7 collects the coins 29 from the hopper or coin storing unit 1, which are positioned in the cavities 8 of the driving disc 7. In this first phase the coins are only transported to the outlet area 6, FIGS. 14 and 15, and the retractable parts 13 are extended at all times, FIG. 8, demarcating the circular cavities 8 for the coins 29. The second extraction phase begins when a coin 29 finds the flanges 23 of the base disc 9, FIG. 16. Said flanges 23, since having a maximum height equal to the thickness of the coin with the least thickness allowed, will act exclusively as a retaining stop on a coin 29 which will transmit this action to the bevel 28 of the retractable parts 13, FIG. 21, causing it to move in a direction perpendicular to the driving disc to the retracted position, FIGS. 9 and 18, all as a result of its bevelled geometry 28, FIGS. 8 and 9, and that the tension of the spring 16, FIGS. 7 and 8, driving the retractable part 13 towards its extracted position is less than the tension of the spring 24-34, FIGS. 3 and 27 driving the stop 23 towards its advanced position, thus allowing the coin 29 to pass to the coin extraction area 6. In a possible embodiment, the spring 24-34 can have greater tension than the spring 16. Once the retractable part 13 has been retracted, FIG. 9, the third phase begins. The stops 23 of the base disc 9 continue to exert force on the coin 29, which is moved by the wall 22, FIG. 19. In this phase two simultaneous movements happen, the coin 29 rested on the wall 22 of the driving disc 7 being moved, and the base disc 9 rotates in the same rotation direction as the driving disc 7 due to the coin 29 pushing on the stops 23. The duration of this phase and the path rotated by the base disc 9 will depend on the size of the coin 29 to be ejected, said phase finishes when the coin 29 reaches the coin outlet area 6 of the chamber 5 of the coin dispenser, at that time the final coin extraction phase will begin. In this fourth phase, FIGS. 17 to 20, the coin 29 finds the outlet area 6 of the coin extractor 3 and due to the force exerted on the coin by the base disc 9, through the stops 23', the coin 29 tends to exit said coin outlet 6 ejected at high speed due to the action of the spring 24 of the base disc, FIG. 3, which rotates as the coin is exiting, in a direction opposite to that of the driving disc 7, and drives the extracted coin outwards.

FIGS. 14 to 20 thus depict the solution to the typical problem of dispensers of the state of the art, as a result of the action of the retractable parts 13, the stops 23 of the base disc 9 and the supporting wall 22 for supporting coins 29 of the driving disc 7.

How the coins 29 are extracted one by one will be described below, from an initial phase in which the coins are in the housing cavity 8 in an area prior to the coin outlet area 6, until they are completely ejected.

In the first extraction phase for extracting the coins 29, as can be seen in FIG. 14, the coin 29 is in the cavity 8 in an area different from that of the coin outlet area 29. In said position the retractable parts 13 are completely extended, as can be seen in the detailed view in FIG. 15, limiting the cavities 8.

Figure 21:
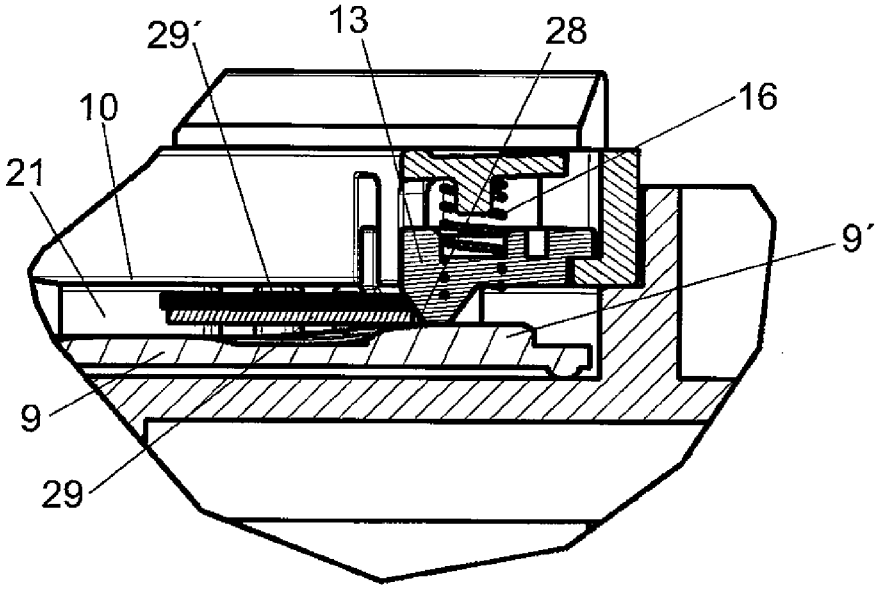
FIG. 21 is a cross-section view similar to FIG. 15 including two coins overlapping in the same cavity.

FIG. 21 exactly depicts the same situation described for FIG. 15, with the difference being that instead of one coin, two overlapped coins 29 and 29' of the smallest diameter allowed for said range are positioned in the cavity for coins of the driving disc 7.

Figure 18:
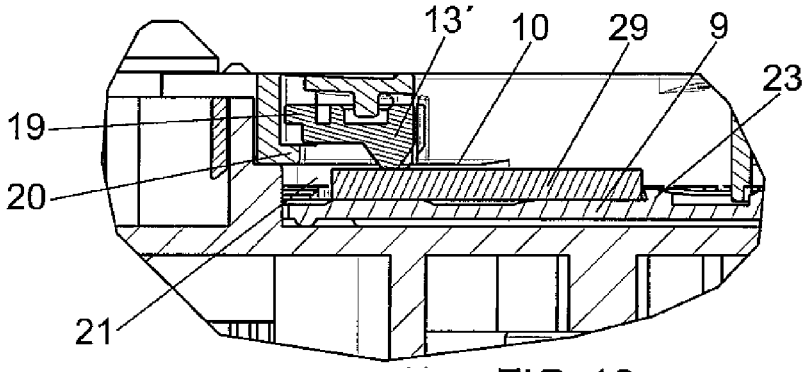
FIG. 18 is a partial cross-section view of the extractor taken according to section line XVIII-XVIII of FIG. 17.
Figure 23:
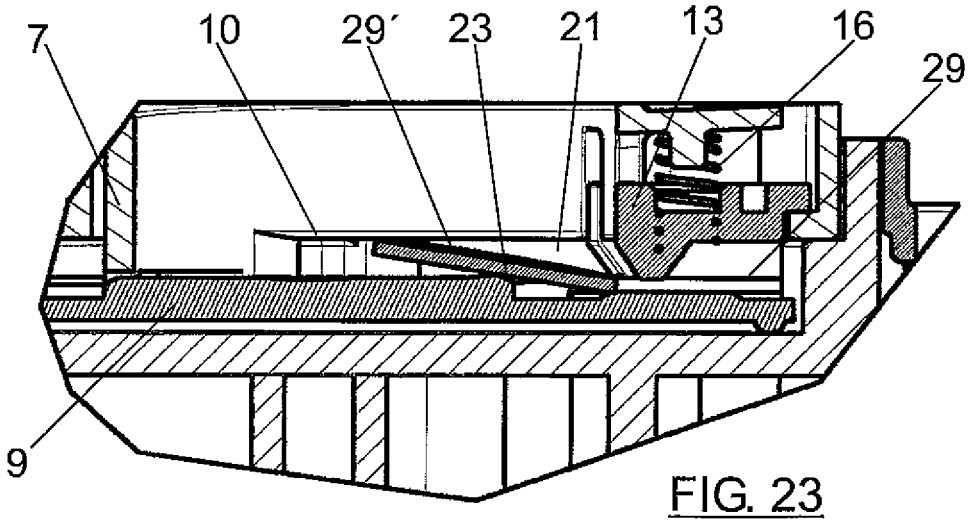
FIG. 23 is a view similar to FIG. 22 showing a subsequent exit phase for the exit of the coin located in the lower position.

As can be seen in FIGS. 18, 21 and 23, a path 21 which is partially blocked by the retractable part 13 in the extracted position thereof is demarcated between the notch 10 of the driving disc and the base disc 9.

FIGS. 14 and 15 depict the coin 29 in an area close to the coin outlet area 6. In this position the base disc 9 is still in its resting position, and the coins 29 are still not exerting pressure on the retractable parts 13.

FIG. 21 exactly depicts the same situation described for FIGS. 14 and 15, with the difference that instead of one coin, two overlapped coins 29 and 29' of the smallest diameter allowed for said range are positioned in the coin cavity 8 of the driving disc 7, on the surface of the base disc. It can be seen how two coins of the smallest diameter allowed for said range are positioned when they move closer to the coin outlet area 6 the moment before the stops 23 of the base disc 9 begin exerting force against them.

FIGS. 17 and 18 depict the coin 29 in its second extraction phase, when the coin is in the coin outlet area 6. In this position the stops 23 of the base disc 9 are exerting force against the retractable part 13 on the bevel edges 28, moving it to the retracted position 13' of FIG. 18, allowing the coin 29 pass out of the driving disc 7.

Figure 16:
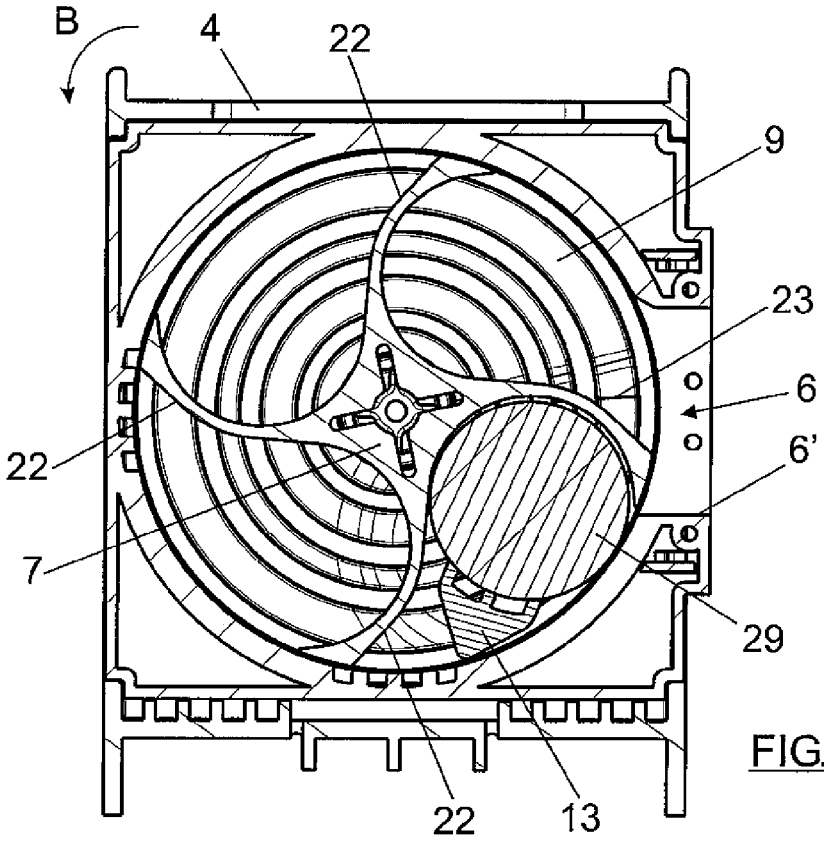
FIG. 16 is an elevational view similar to FIG. 14 with the sectioned driving disc and the coin close to the extraction point.
Figure 19:
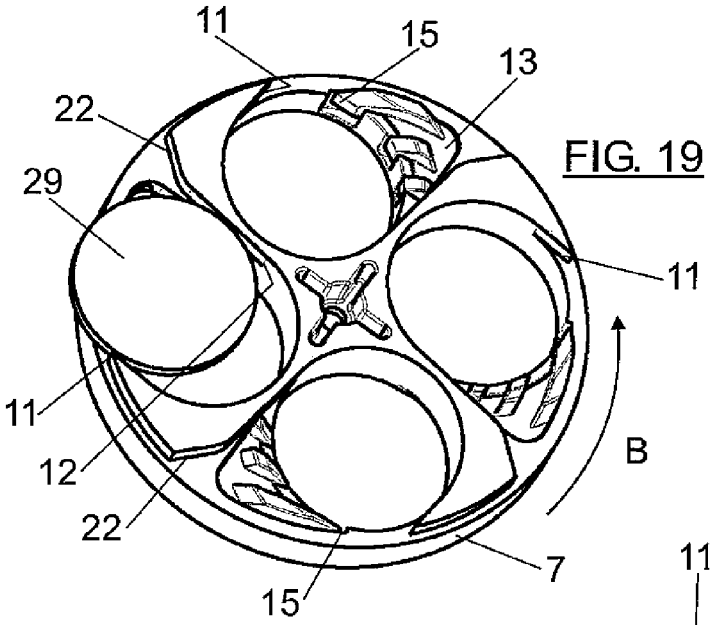
FIGS. 19 and 20 are perspective views of the rear part of the coin driving disc with a coin in the ejection phase.
Figure 20:
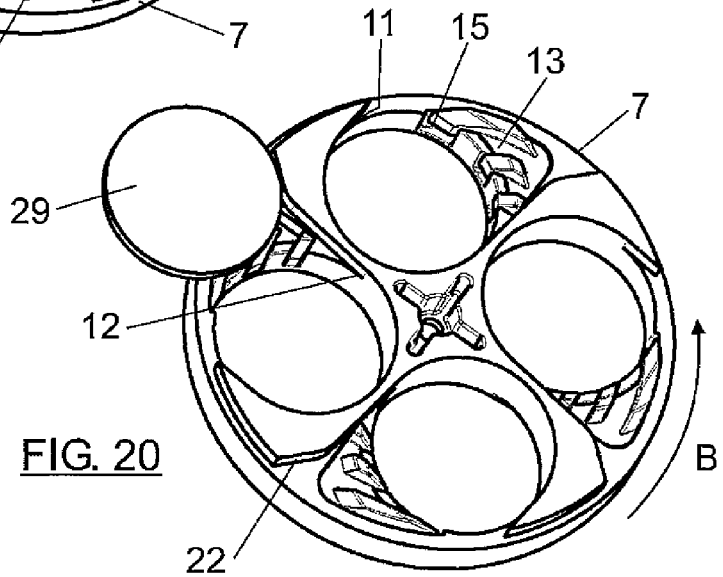

Once the retractable part 13 has allowed the coin 29 to pass, the third phase in coin ejection begins. The coin 29 bears against the wall 22 of the driving disc 7, as shown in FIGS. 19 and 20. The base disc 9 driven by the coin, which is in turn driven by the driving disc 7, simultaneously rotates in the same rotation direction as the driving disc 7, as can be seen in FIGS. 16 and 17.

Figure 22:
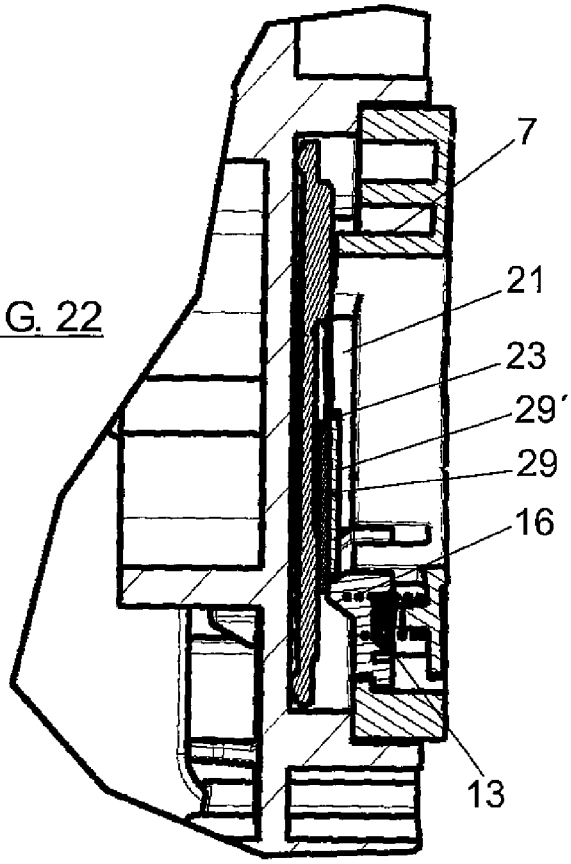
FIG. 22 is a cross-section view similar to FIG. 18 with two overlapping coins included in the same cavity.

FIGS. 21 and 22 depict a situation equivalent to that described for FIGS. 15 and 18, with the difference that instead of one coin, two overlapped coins 29 and 29' of the smallest diameter allowed are positioned in the coin cavity 8 of the driving disc 7. In the detailed view of FIG. 22, it can be seen how two coins of the smallest diameter allowed are positioned when they are in the coin outlet area 6 at the time in which the flanges 23 of the base disc 9 begin to exert force against the coin 29 occupying the lower position. In detailed FIG. 22, it can be seen how in the case of two coins 29-29' positioned in one and the same cell, only the coin positioned closer to the ejector disc will pass to the outside area of the coin driving disc 7 overcoming the retractable part 13, since it will be the only one interfering with the stops 23 of the base disc 9 because the height of these stops is calculated so that it will in no case be greater than the thickness of the coin of least thickness allowed thus carrying out the third extraction phase. Therefore, the coins which are not positioned on the surface of the base disc 9 will not be ejected out of the dispenser, thus assuring the extraction of the coins one by one, as can be seen in FIG. 23.

The fourth extraction phase for extracting a coin 29 takes place when said coin finds the coin outlet area 6. With the disc extractor 7 resting, the dimension of the coin outlet opening 6 is defined by the distance between the stops 23 and the lower part 6' of the outlet 6, FIGS. 16 and 24, said dimension being less than the diameter of the coin of smallest diameter allowed. In this fourth phase, the coin 29 reaches the outlet area 6 of the coin dispenser. In these conditions and due to the force exerted on the coin by the base disc 9 through the stops 23 the coin 29 tends to exit through the opening created in the coin outlet area 6 of the dispenser, and it is ejected once the ejector disc has rotated enough so that the distance from the stops 23' to the lower part 6' of the outlet 6, FIG. 17, allows the exit of the coin 29. The expulsion of the coin occurs at high speed due to the action of the spring 24 of the base disc 9 causing said base disc 9 to rotate in the direction opposite that of the driving disc 7, as the coin 29 exits, until reaching its resting position once more, FIG. 16, driving the coin towards the outside. Once the coin 29 has been extracted, the retractable parts 13 will return to their fully extracted resting positions, FIGS. 15 and 21, as a result of the action of the springs 16, FIGS. 7 and 8, the same as the base disc 9, as a result of the action of the return spring 24, FIG. 3. The extractor system will thus be about to perform the next coin extraction.

FIGS. 25 to 29 depict a variant of the base disc 9 of FIG. 3. In this embodiment variant the base disc, indicated with reference 30, is fixed and has arched grooves 31 concentric with said disc and of angular width at least equal to the above described movement of the stops 23 between their advanced, FIG. 14, and retracted positions, FIG. 17. The stops are made up of teeth 32 which, like the stops 23, are radially aligned. These teeth form part of a sector 33 located behind the base disc 30, concentric with said disc and rotary with respect to same, together with the driving disc 7, between the advanced and retreated positions of the stops 23, FIG. 24. The sector 33 is driven towards the advanced position of the teeth 32 by means of the spring 34 and as in the embodiment of FIG. 3, the tension of this spring 34 is greater than that of the spring 16 of the retractable part 13, FIGS. 7 and 8. The height of the teeth 32 will meet the conditions set forth for the stops 23.

Moreover, both the functionality and the operating mode of this system are identical to that described for the base disc 9.

The variant of FIGS. 25 to 29 has the advantage that the coins 29 bear against the fixed disc 30 and not against the movable base disc 9, whereby achieving better behaviour of the system by reducing the friction between coin and base disc.

In the described embodiments, the cavities 8 of the driving disc 7 have a straight cylindrical configuration, i.e., the axis is perpendicular to the surfaces of said driving disc.

Figure 28:
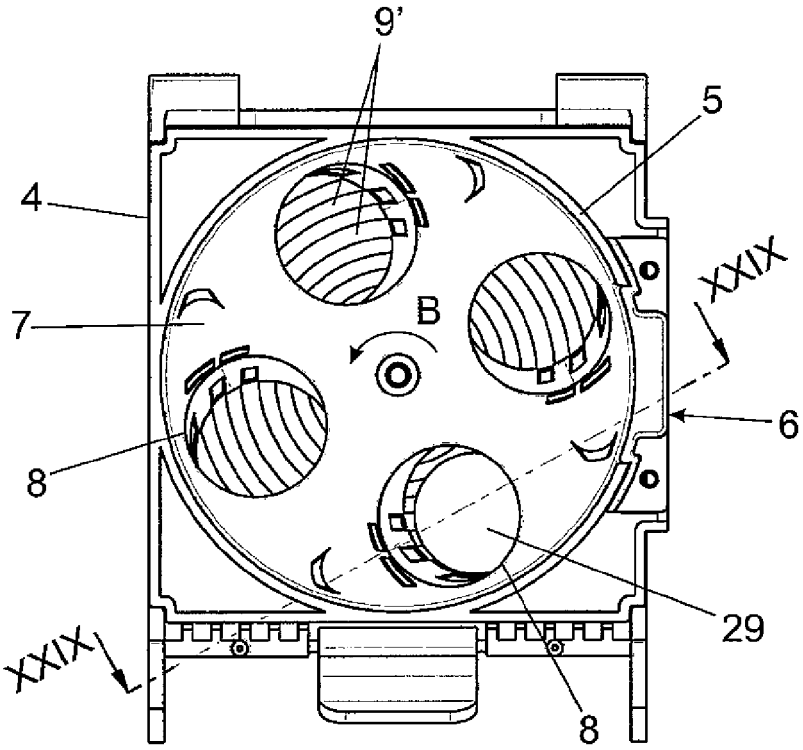
FIG. 28 is a view similar to that of FIG. 14 showing a preferred embodiment of the cavities of the driving disc.
Figure 29:
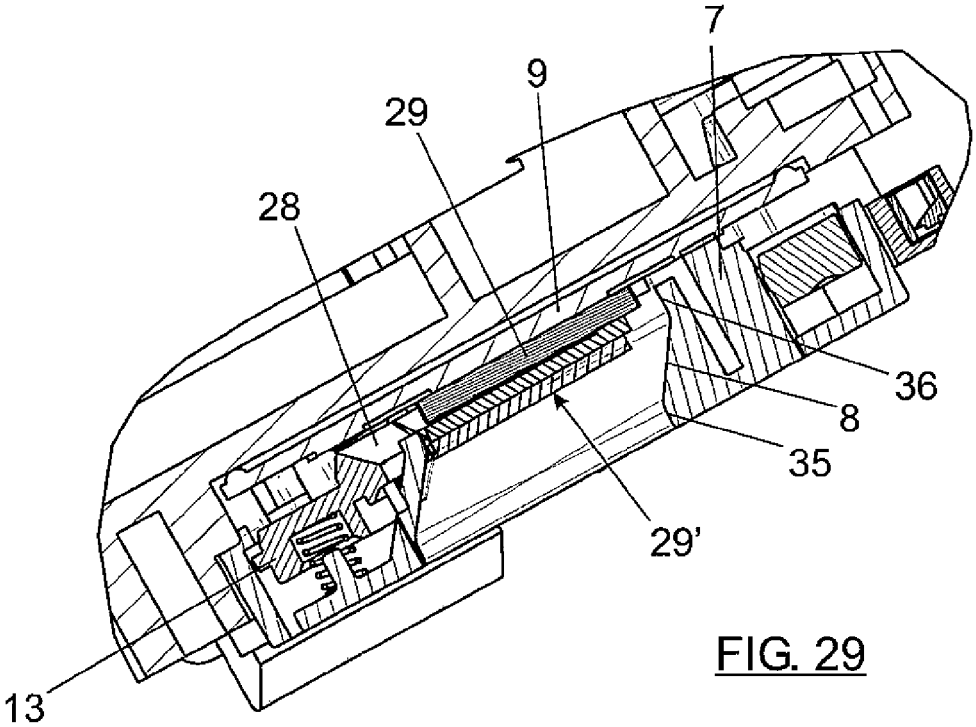
FIG. 29 is a cross-section view of the extractor taken from section line XXIX-XXIX of FIG. 28 on a greater scale.
Figure 30:
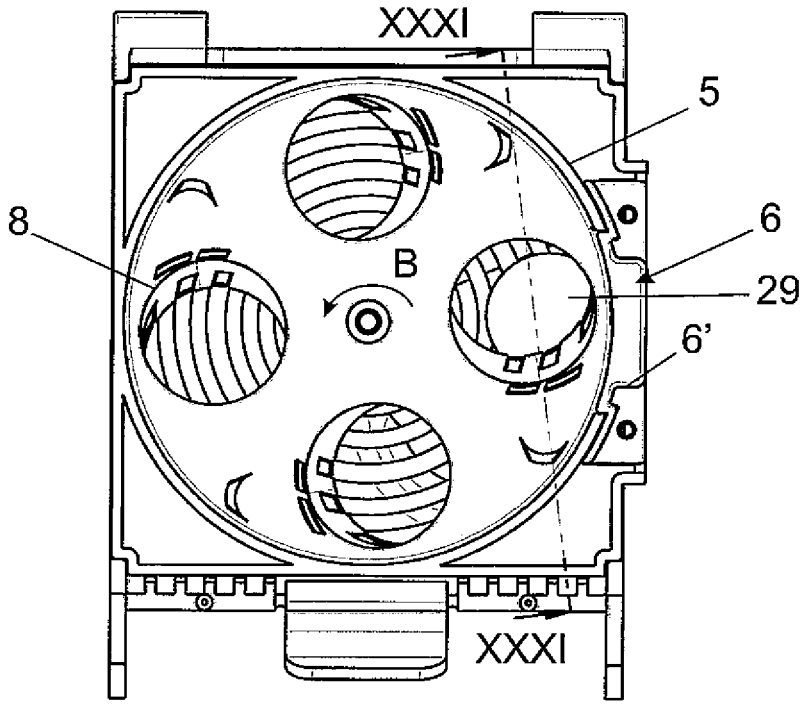
FIG. 30 is a view similar to that of FIG. 16 with the driving disc of FIG. 28.

However it has been discovered that the operation of the dispenser improves when the cavities 8 of the driving disc 7 adopt an oblique cylindrical configuration with an inclination in circumferential direction, opposite to the rotation direction of said driving disc, as shown in FIGS. 28 to 30. Moreover, the constitution of the driving disc 7 coincides with that described referring to FIGS. 4 to 9.

In FIG. 28, which is a view similar to FIG. 14, with the same references to designate the same elements or parts, and in the cross-section shown in FIG. 29, the inclination of the cylindrical cavities 8 which can end in end sections 35 and 36 having straight cylindrical configuration can be clearly seen.

FIG. 28 only shows the coin 29 occupying the innermost position in the cavity 8, while FIG. 29 shows how the different coins are positioned inside the cavities, the upper coins 29' being stacked on the lower coin 29 in a staggered manner. The straight cylindrical sections 35 and 36 facilitate the entry of the coins, as well as the correct positioning of the innermost coin 29.

Figure 31:
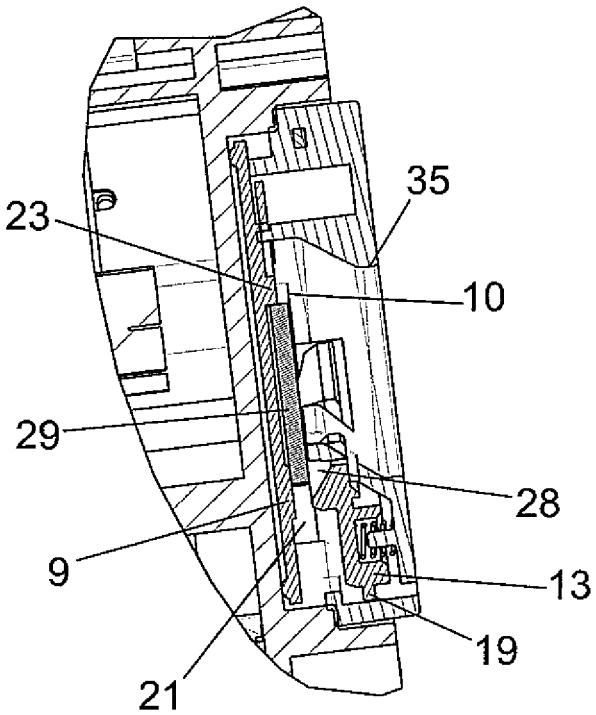
FIG. 31 is a partial cross-section view of the extractor taken according to section line XXXI-XXXI of FIG. 30 on a greater scale.

When the cavities 8 reach a position facing the outlet 6, FIGS. 30 and 31, in which the innermost coin 29 is facing the bevels 28 resting on same and causing the retraction of the retractable part 13, FIG. 31, to thus allow the passage of the innermost coin 29 towards the outlet 6.

Due to the inclination of the wall of the cavities the coins are successfully stacked with staggered and non-coinciding edges as occurs when the cavities have straight cylindrical configuration is achieved. This circumstance facilitates the fact that only the coin 29 occupying the innermost position can rest on the bevel 28 of the retractable part 13 when it reaches the outlet area 6, causing its retraction and assuring the passage of only one coin, without the risk of jams occurred due to the action of the next coin in the stack, the edge of which does not reach the bevels 28.

The process of extracting the coins 29 and 29' is performed in a manner similar to that described above.

The oblique cylindrical configuration of the cavities 8 allows successfully stacking coins inside the cavities with staggered edges, reducing the risk of jams due to misplacing the coins, which in summary allows a greater uniformity in coin extraction.

Also with the described configuration of the cavities, the positioning of the coins in a direction perpendicular to the plane of the base disc is greatly reduced or prevented and the range of allowed coin diameters is increased.

WO 2006/079803 describes a coin dispenser which has an outlet opening for the exit of coins and a coin dispensing mechanism comprising a rotary disc provided with cylindrical cavities for coins, means for pushing the coin towards the outlet opening which means occupy the lower position in the cylindrical cavities and means for controlling the exit of the coins, one by one, through the outlet opening.

The means for pushing the coins towards the outlet opening consist of retractable stops which protrude from the bottom of the deposit in a fixed radial position, coinciding with the outlet opening, and block the circumferential trajectory of the cavities, pushing the coin occupying the lower position in the cavity facing the outlet opening towards said opening. The means for controlling the exit of the coins in turn consist of two retractable arched gates which are assembled in a position concentric with the rotary disc, in an inverted channel surrounding said disc coinciding with said outlet opening, said gates having an inclined lower profile.

With the described constitution, the two retractable arched gates make up the means for controlling the exit of the coins from all the cavities, such that the operation problems of any of the gates could alter the operation of the entire dispenser.

On the other hand, the exit of the coins occurs only due to the push received by said coins from the retractable stop, where the coin may not reach the end of the outlet due to the friction of the coin along the exiting path, for example if the stop is retracted, or at least doing so at a minimum speed.

With the described constitution, the stops 23 perform two functions. In their advanced position they act, together with the retractable parts 13, as means for controlling the exit of and separating the coins, while in their retracted position they act, together with the rear walls 22 of the driving disc 7, for pushing and ejecting the coins through the coin side outlet 6. As a result of the joint action of the rotating stops 23 and the convex-curved surface of the rear walls 22, towards the opening of the outlet 6, the coins are successfully ejected at high speed, which has the additional advantage of increasing the distance between two consecutive coins, allowing a greater rate of coins per second without jamming problems. In turn, the retractable stop 13 in each housing 8 allows increasing the range of allowed diameters since said stops are limiting the cavity on its lower part.

The invention claimed is:

1. A coin dispenser comprising:

a coin storing unit and a coin extractor, the extractor comprising a casing defining a cylindrical chamber with a side outlet for an exit for coins, wherein there is housed a rotary driving disc limiting the coin storing unit on one side and having a series of circumferentially distributed cavities, closed on a side opposite to that occupied by the coin storing unit by a supporting base, the coins are housed in said cavities, said cavities having in their wall and from an edge facing the supporting base, a notch demarcating, with said base, a path facing the side outlet of the cylindrical chamber, a stop opposite to a rotation direction of said disc protruding from the surface of the supporting base facing the driving disc, radially crossing a circular trajectory of the cavities of the driving disc and having a height equal to or less than the thickness of a coin with the least thickness handled by the dispenser, the stop being movable according to a circular trajectory concentric with the driving disc between an advanced position, in which the stop faces the side outlet of the cylindrical chamber, limiting the length of said outlet to a dimension less than a diameter of the coin with the smallest size handled by the dispenser, and a retracted position, in which the stop is located directly behind the side outlet according to the rotation direction of the driving disc, freeing said exit, the stop being constantly driven towards the advanced position by a spring, and wherein the driving disc has a retractable part for each cavity blocking the corresponding notch and a rear coin guiding wall located after the retractable part, which starts in a position tangent to said cavity and nuns with an arched route towards the periphery of the disc, with convexity directed towards the retractable part, said wall having a height at least equal to the thickness of the coin with the least thickness handled by the dispenser.

2. The dispenser according to claim 1, wherein the retractable part is assembled in a housing having the driving disc on the surface facing the supporting base, from the notch of each cavity, the retractable part of which is movable in a direction perpendicular to the supporting base between a position of maximum extraction, in which the retractable part is separated from the supporting base by a distance less than the thickness of the coin with the least thickness handled by the dispenser, and a position of maximum retraction, in which the retractable part is separated from the supporting base by a distance at least equal to the thickness of the coin with the greatest thickness handled by the dispenser, the retractable part being driven towards the extracting position by a spring assembled between said retractable part and the bottom of the housing.

3. The dispenser according to claim 1, wherein the retractable part is limited on the side directed towards the cavity, by an inclined surface, retracted downwards against which the coins driven through said cavity rest.

4. The dispenser according to claim 1, wherein the cavities of the driving disc have a diameter at least equal to the diameter of the coin with the largest dimension handled by the dispenser and less than twice the diameter of the of the coin with the smallest diameter handled by the dispenser.

5. The dispenser according to claim 2, wherein the movement of the retractable parts between the positions of maximum extraction and retraction is slightly greater than the thickness of the coin with the greatest thickness handled by the dispenser.

6. The dispense according to claim 1, wherein the supporting base comprises a base disc arranged between the bottom of the cavity and the driving disc, concentric with said driving disc.

7. The dispenser according to claim 1, wherein the base disc rotates together with the driving disc between the advanced and retracted positions of the stop; and wherein said stop comprises one or more flanges protruding from the base disc, radially aligned thereon.

8. The dispenser according to claim 1, wherein the base disc is fixed and has arched grooves, concentric with the driving disc and has an angular width at least equal to the movement of the stop between the advanced and retracted positions, and wherein said stop comprises teeth located below the fixed base disc, radially aligned with respect to the disc, coinciding in number and position with the arched grooves, the teeth of which protrude through the grooves in a height equal to or less than the thickness of the coin with the least thickness handled by the dispenser and are movable along the arched grooves to define the advanced and retracted positions of the stop.

9. The dispenser according to claim 8, wherein the teeth protrude from a sector which is arranged concentric with the fixed base disc and the sector rotates with respect to said base disc, together with the driving disc, between the advanced and retracted positions of the stop.

10. The dispenser according to claim 1, wherein the retractable parts have side protrusions which are located behind the stops which protrude in positions facing the wall of cavities and limit the position of maximum extraction.

11. The dispenser according to claim 1, wherein the cavities of the driving disc have an oblique cylindrical configuration with an inclination in a circumferential direction opposite to the rotation direction of said driving disc.

* * * * *

UNITED STATES PATENT AND TRADEMARK OFFICE

CERTIFICATE OF CORRECTION

PATENT NO. : 8,435,102 B2
APPLICATION NO. : 13/457266
DATED : May 7, 2013
INVENTOR(S) : Miguel A. Calleja LaFuente et al.

It is certified that error appears in the above-identified patent and that said Letters Patent is hereby corrected as shown below:

In the Specification

Column 11, line 20:

"nuns" should read "runs"

In the Claims

Column 12, line 9:

"dispense" should read "dispenser"

Signed and Sealed this
Twentieth Day of August, 2013

Teresa Stanek Rea
*Acting Director of the United States Patent and Trademark Office*